US006513276B2

(12) United States Patent
Mendoza-Orozco

(10) Patent No.: US 6,513,276 B2
(45) Date of Patent: Feb. 4, 2003

(54) MICROMETRIC RIFLE SIGHT

(76) Inventor: Hector Mendoza-Orozco, Avenida Constitucion 57, Colonia San Pedro Tepalcatlalpan 16210 Xochimilco, D.F. (MX)

( * ) Notice: Subject to any disclaimer, the term of this patent is extended or adjusted under 35 U.S.C. 154(b) by 0 days.

(21) Appl. No.: 09/879,667

(22) Filed: Jun. 13, 2001

(65) Prior Publication Data

US 2002/0152664 A1 Oct. 24, 2002

(30) Foreign Application Priority Data

Apr. 19, 2001 (MX) ..... 003916

(51) Int. Cl.[7] ..... F41G 1/26
(52) U.S. Cl. ..... 42/137
(58) Field of Search ..... 42/137, 111, 126, 42/143

(56) References Cited

U.S. PATENT DOCUMENTS 2,356,182 A * 8/1944 Schaich ..... 33/56
3,834,035 A * 9/1974 Merrill ..... 33/251
3,838,522 A * 10/1974 Williams ..... 33/258
4,477,979 A * 10/1984 Oren ..... 33/257
4,606,131 A * 8/1986 Domian ..... 33/257
4,837,937 A * 6/1989 Hasselbusch ..... 33/257
6,112,422 A * 9/2000 Laiche, Jr. ..... 33/252

* cited by examiner

*Primary Examiner*—Charles T. Jordan
*Assistant Examiner*—Bret Hayes
(74) *Attorney, Agent, or Firm*—Harrison & Egbert

(57) ABSTRACT

A micrometric sight placed on the barrel of a gun for use with either an open-type sight or for use with a closed-type sight. The sight includes a base having a fixed part and a movable part. The base can be affixed to a dovetail formed on the barrel of the gun. An upper support is joined to a side plate to form an angled piece. A micrometric height adjustment screw is on the upper support for adjustment of the height. A micrometric centering screw is provided between the upper support and the base for proper centering.

3 Claims, 6 Drawing Sheets

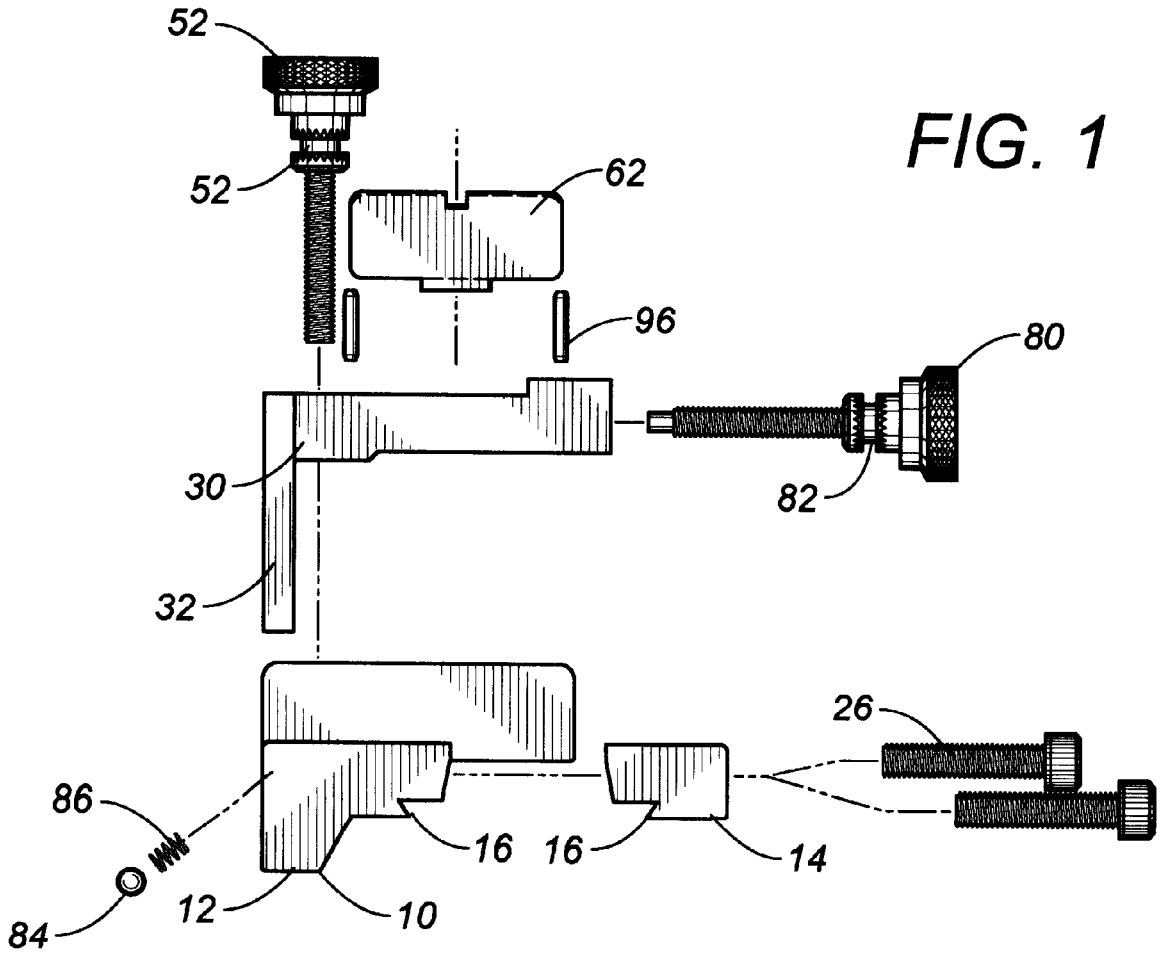
FIG. 1
FIG. 2
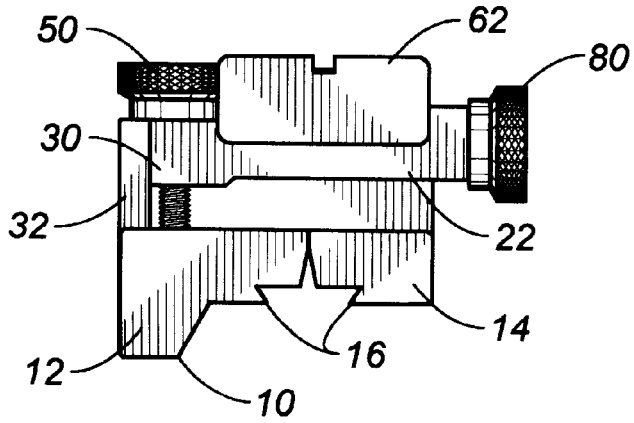

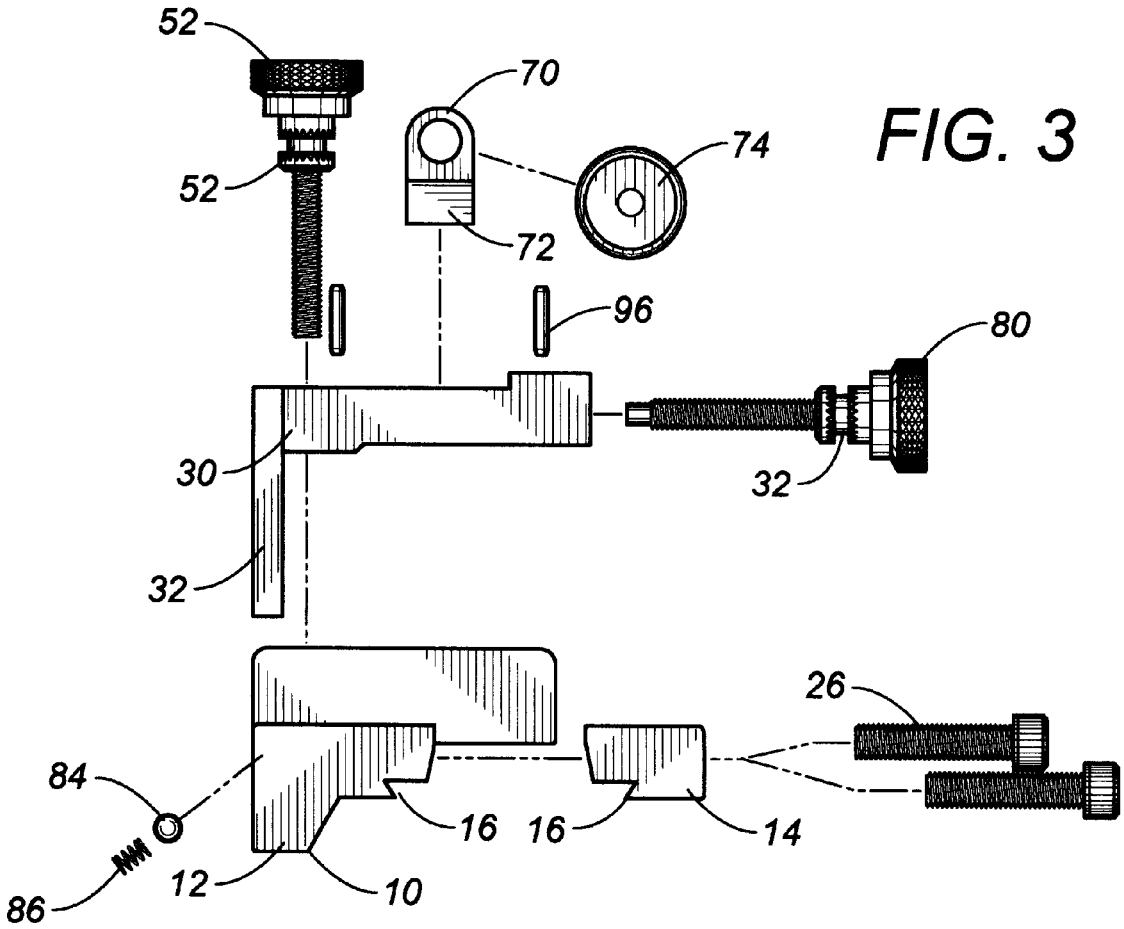
FIG. 3
FIG. 4
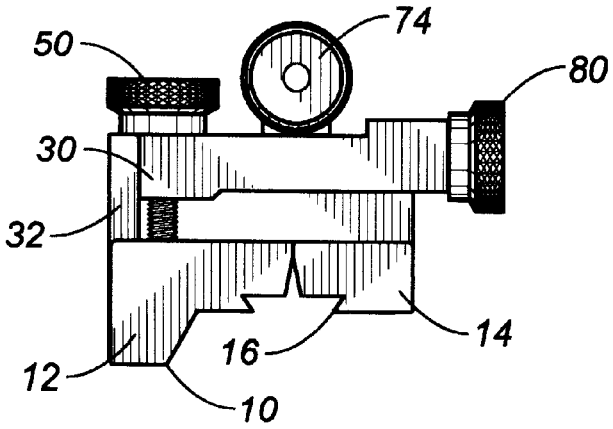

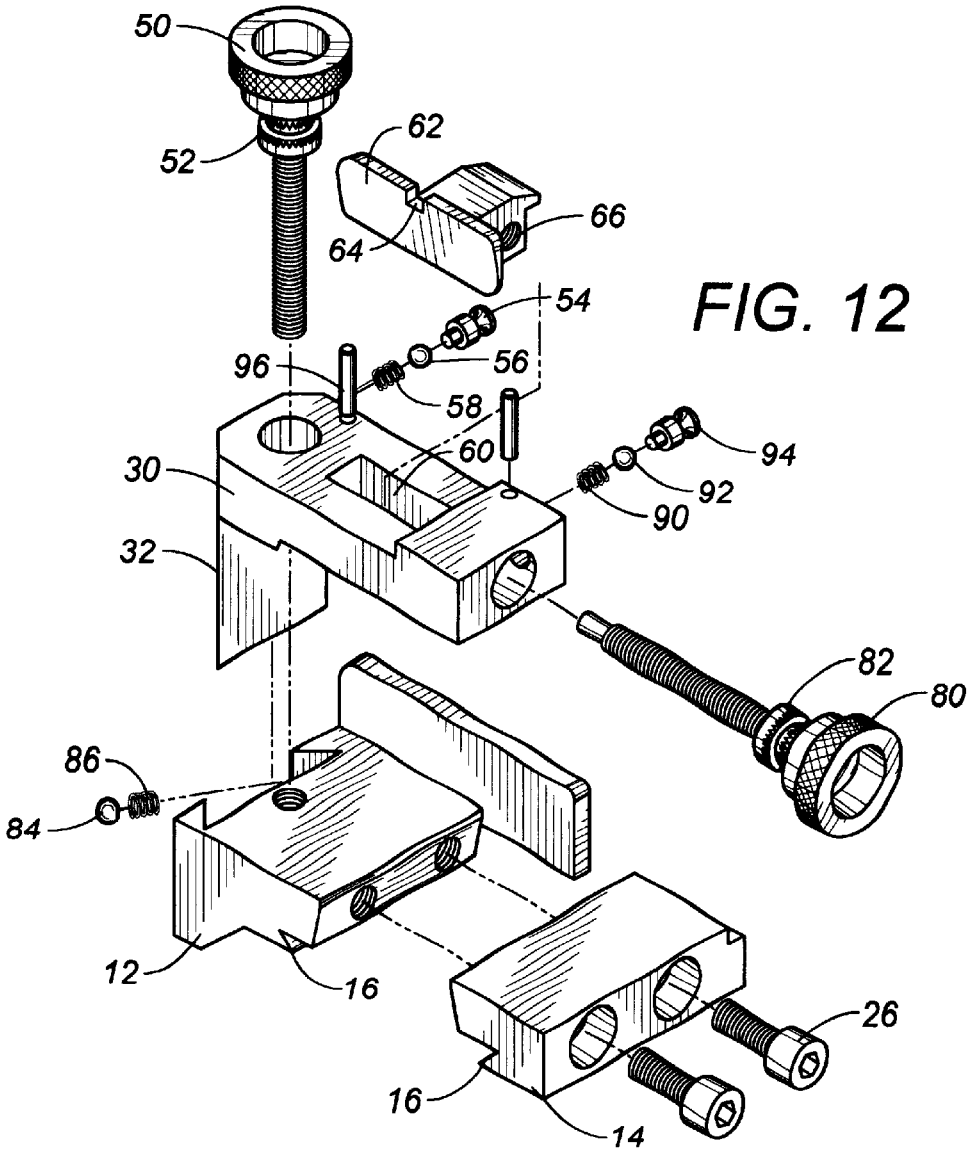
FIG. 12
FIG. 13
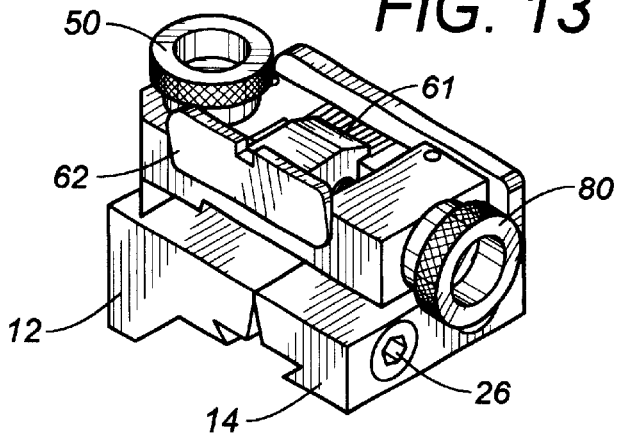

MICROMETRIC RIFLE SIGHT

BACKGROUND OF THE INVENTION

1. Field of the Invention

This invention refers to a novel micrometric sight, which will be naturally placed towards the back of the gun's barrel, with the possibility of changing such micrometric sight, which allows its adjustment for both height and compensation, either for an open type sight or for a closed type sight, with which very precise grouping results are obtained.

2. Description of Related Art

All gun sighting apparatus are composed of a rear sight that may be fixed or semi-fixed, and a front sight or aiming point, whose function is to orient the gun's sight towards a chosen point.

Given the fact that guns have existed since early times in history, the oldest known precedent consists of a fixed sight made of a plate with a "V"-shaped cut-out at the front mounted towards the back of the gun's breechblock and a sighting point at the front of the gun's barrel.

This primitive invention was modified by means of a plate mounted with a small "V"-shaped cut-out at the front, is mounted on a folding lug, whose purpose is to adjust the field of view in relation to the distance.

The most recent precedent consists of a base mounted on the dovetail of the gun's barrel, and adjustable by both pressure and for the type of sight through the movement thereof along the dovetail's slides and from which an upper arm is released, consisting of a rectangular piece and an angled side support, which may slide along a dovetail slide placed laterally on the body of the base, including screws to raise the upper arm, as well as a screw located laterally to move and adjust a plate with a "V"-shaped cut-out and which is used for the installation of the rear sight and adjust it with the front sight.

In practice it has been seen how, at the moment of shooting the gun with relative frequency, the rear sight must be constantly adjusted, consisting of moving both the plate that is used for the placement of the sight and the angled side plate and the body of the sight's base, requiring a small screwdriver and an alien key for its adjustment to be carried around, which is annoying for the user of the gun.

The misadjustment of the rear sight is basically due to the frequent impacts with great force when the gun is being fired.

It has also been seen that between the base and the upper support there is a small space through which light filters, consequently distracting the user from the target being aimed at, and this is solved by some users by means of a small piece of cardboard adhered to the upper arm of the sight. This solution is not the most suitable as, understandably, the frequent yanks of the gun when being fired throw the small piece of cardboard to the ground.

When the user wishes to fire several shots with different fields of view (grouping), the plate with in "V"-shaped cut-out in the center (open sight) has to be changed for an optical sight (closed sight) moved to the back of the gun's barrel. This change of sight necessarily causes adjustments to the sight that the user must make with precision. In practice these adjustments have become a true problem, as the different parts of existing sights do not possess mechanisms that offer precise adjustment.

The foregoing problems are satisfactorily solved by this invention, whose advantages can be briefly described as follows: rapid and safe adjustment of movement of the sight's position on the dovetail; adjustment of the height of the upper support by means of a micrometric adjustment screw; elimination of the space between the base and the side support incorporating a plate which acts as a screen; adjustment of the angled plate of the rear support by means of a spring with a ball situated perpendicular to the rear face of the angled plate of the rear support, the plate therefore being pressed against the dovetails, thus avoiding unnecessary adjustments.

BRIEF SUMMARY OF THE INVENTION

This invention refers to a novel micrometric sight, which will be naturally placed towards the back of the gun's barrel, with the possibility of changing such micrometric sight, which allows its adjustment for both height and compensation, either for an open type sight or for a closed type sight, with which very precise grouping results are obtained.

Additionally, a screen has been incorporated into the micrometric sight, which is located between the space in the sight's base that is situated on the gun's breechblock and the main support where the sight is observed, all with the aim of avoiding distraction from the target.

The sight has also been given several cavities on the side of the sight's base, into which several springs are introduced with a ball that exerts pressure on the side plate of the upper support, whose purpose will be to tighten the slide on the upper support, therefore not requiring the need to move the upper support to adjust the sight during shooting by means of a special key or tool.

Finally, the base of the sight has been improved, having a clamp with a larger contact area and reinforced so that it can be tightened on the sliders of the dovetails located at the top of the gun's breechblock. Therefore, one of the aims of this invention is to possess a micrometric sight placed on the dovetails of a rifle, which can be changed for an open or closed sight by simply changing a few pieces.

Another purpose of this invention is to possess an element incorporated into the micrometric sight consisting of a vertical plate that acts as a screen and with which visual distraction from the target when shooting is avoided.

Another objective of this invention is to possess an element which is incorporated into the side body of the base and which firmly presses against the slide of the dovetail of the upper support, and therefore does not require a special key or tool for its correction, as this element allows the adjustment of the side body.

Another aim of this invention is to possess a gun provided with a micrometric sight that allows precise adjustments to be made using micrometric screws and consequently, allowing exact adjustment.

Another result of this invention, is that it comes with a pressing clamp placed at the bottom of the base of the micrometric sight, and which is located on the dovetail of the gun's breechblock, which is firmly tightened and which satisfactorily meets the safety provisions and standards established by the different authorities in Mexico and abroad, particularly in the United States of America.

Although in this case, a mechanism of a micrometric sight for a gun is being presented, it is obvious that later and simple modifications may be made, which do not affect the essence and scope of this invention. Furthermore, considering the fact that one of more of the characteristics of this invention may be applied in another field of action, such applications must be considered as a modality of this invention and not as a new invention.

This invention has its field of action among accessories for all class of guns, specifically rifles.

BRIEF DESCRIPTION OF THE SEVERAL VIEWS OF THE DRAWINGS

FIG. 1 is an exploded plan view of an open sight.

FIG. 2 is a plan view of the assembled open sight.

FIG. 3 is an exploded plan view of a closed sight.

FIG. 4 is a plan view of the assembled closed sight.

FIG. 12 is an exploded perspective view of the open sight.

FIG. 13 is an upper perspective view of the open sight.

DETAILED DESCRIPTION OF THE INVENTION

Figure 5:
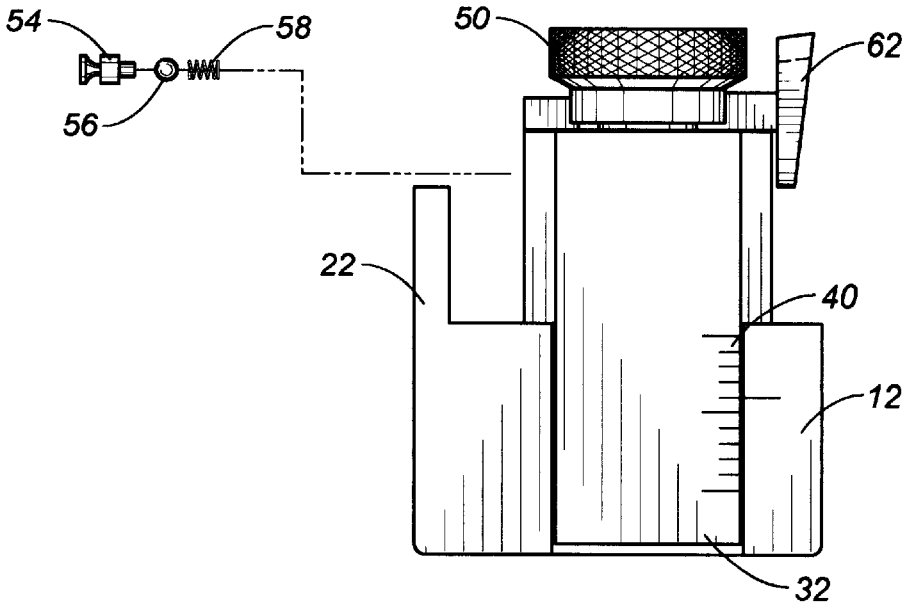
FIG. 5 is a left side view of the open sight.
Figure 6:
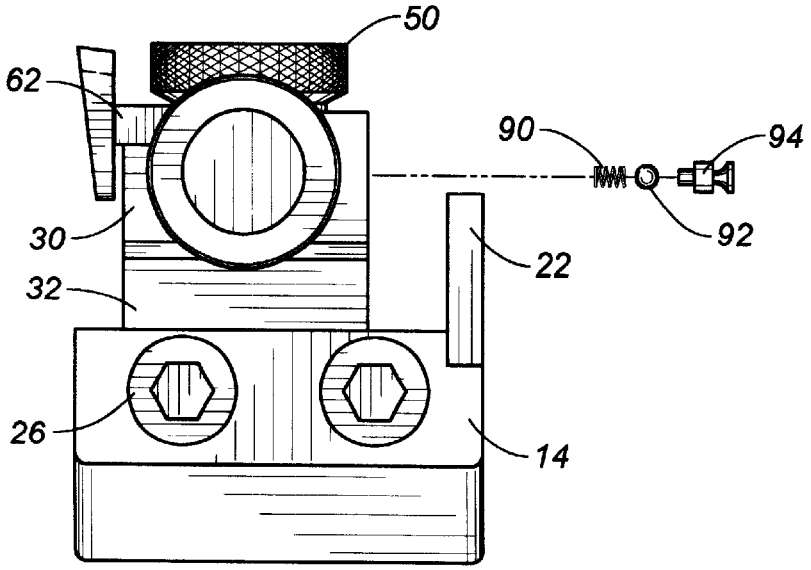
FIG. 6 is a right side view of the open sight.
Figure 7:
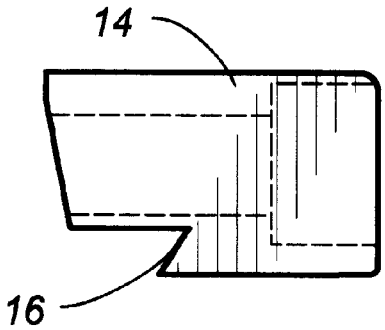
FIG. 7 is a front view of a clamp.
Figure 8:
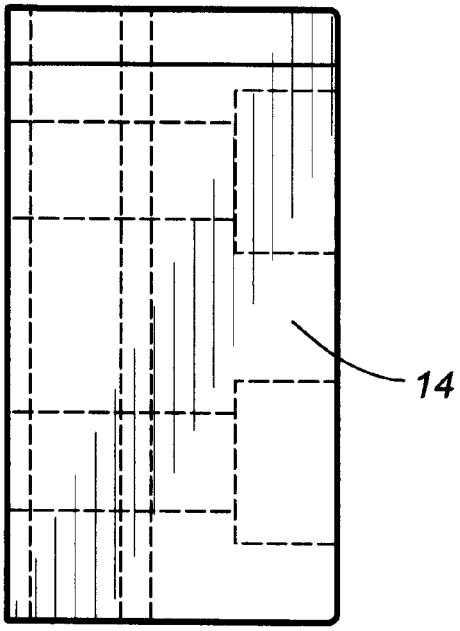
FIG. 8 is a top view of the clamp.
Figure 9:
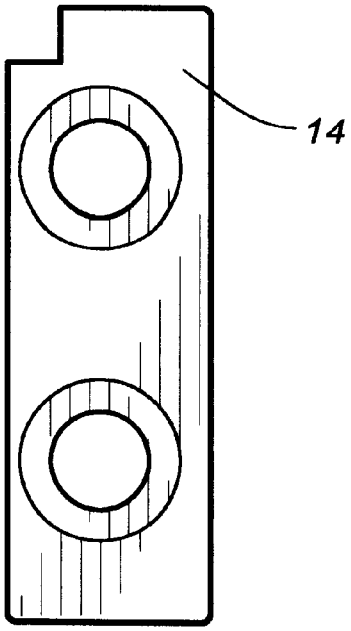
FIG. 9 is a right side view of the clamp.
Figure 10:
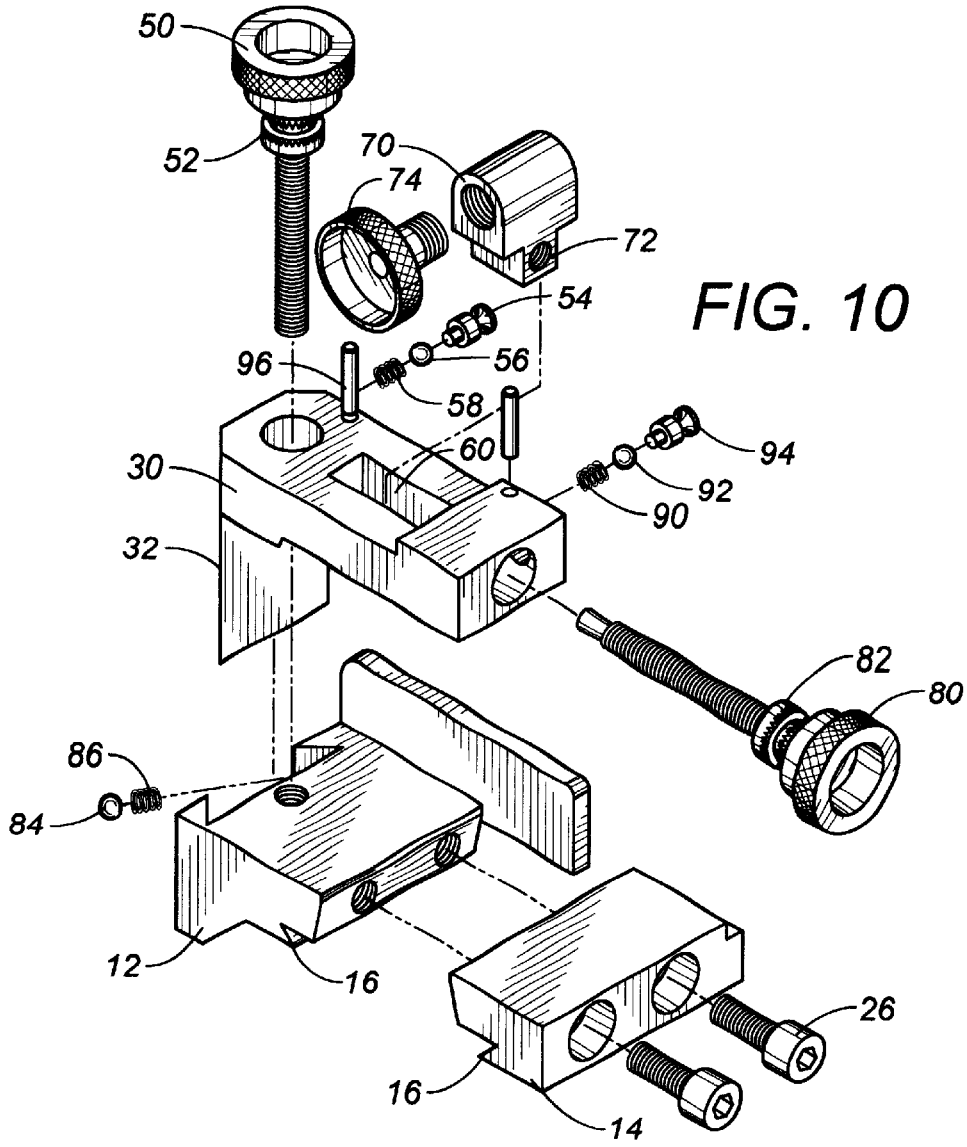
FIG. 10 is an exploded perspective view of the closed sight.
Figure 11:
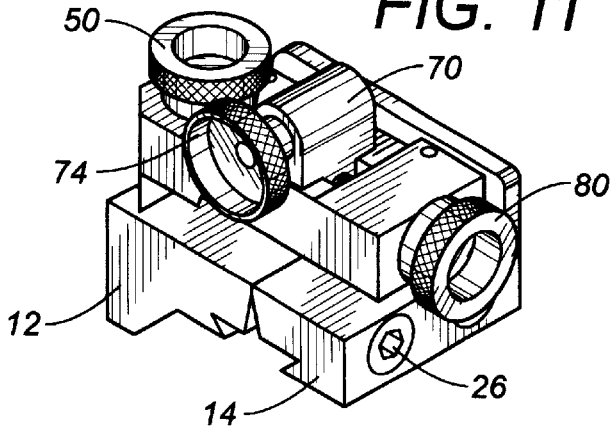
FIG. 11 is an upper perspective view of the closed sight.

This invention refers to a micrometric sight, which is placed on the dovetails located on the gun's barrel, by which an acceptable shot grouping guaranteed.

The characteristic details of this micrometric rifle sight are clearly shown in the following description and in the attached drawings, as an illustration thereof, and acting as references to indicate the same parts shown in the figures.

Referring to such figures, the micrometric sight seen from the front can be summarized by being formed by a base 10, with a fixed part 12 and a moving part 14, which form the clamps with which it is attached to the slide on the dovetails on the gun's breechblock, located towards the back of the gun; an upper support 30, with a flat angled plate 32 formed from a right-angled piece; a micrometric height adjustment screw 50 on the upper support 30 of the sight, either open 62, or closed 70, mounted on the upper surface of the upper support 30; a micrometric centering screw 80 on the sight, either open 62 or closed 70.

This fixed base 12 is formed by a rectangular piece, with a small protuberance that sticks out downward and which has on its left side face a slide or dovetail on which the flat angled plate 32 of the upper support 30 moves, and which has two cavities at the end of its side, by which several setscrews are attached.

This fixed base 12 also has a small inclined cut-out 16, correlative to the dovetail on the gun's breechblock, onto which it rests and to which it is secured, located towards the opposite side of the left face.

The top face of this fixed base 12 has a hole with fine thread 20, through which the micrometric height adjustment screw 50 passes.

The moving part 14, or clamp is provided with a small rectangular piece that has a small inclined cut-out 16 on the inside face, correlative to the dovetail on the gun's barrel, on which it rests and to which it is secured, which is located on the opposite side of the left face.

In order to prevent the user being distracted by the space between the base 10 and the upper support 30, the fixed base 12 has a flat rectangular plate 22, which acts as a screen, thus avoiding the inconvenience described above.

The fastening of the base 10 to the dovetail on the gun's barrel is achieved by means of two set-screws 26, which are placed transversely to the clamp 14, whose function is to be able to tighten the sight so that it doesn't move. Two setscrews 26 are provided as it has been observed that with only one, the pressure exerted is not equally distributed and, on occasions, the sight comes off the dovetail. Conversely, the proposed invention has two set-screws so that the pressure exerted is sufficient, as well as being able to absorb any imperfection that may exist in the dovetail on the gun's breechblock.

The upper support 30, is formed by a rectangular piece, which has a flat rectangular plate 32 at its left end, which forms a right angle. This flat angled plate 32 has a small cut-out on its side faces, correlative to the geometry of the dovetail slide on the fixed base 12, as well as being provided with a lateral scale 40, with divisions as a reference related to the height at which the upper support 30 should be placed.

In order to fix the flat angled plate 32, to the fixed base 12, and so that it remains in a determined position without movement, several cavities are used into which several compressed springs 86 are inserted, preceded by several ball bearings 84, which come into contact with the surface of the rear face of the angled plate 32 and, in this way, exert pressure so that this plate moves along the dovetail.

On the top face of the upper support 30, there is a hole at the end through which the micrometric height adjustment screw 50 is inserted, consisting of a screw with a fine thread and a fluted crown 52 where a ball bearing 58 sits, this being held in position by a spring 56 and the ball bearing 58 and spring 56 in turn being held in position by a cap 54.

This ball bearing 58 and spring 56 are placed on the rear face of the upper support 30, perpendicular to the thread of the micrometric height adjustment screw 50, by means of which the height of the upper support 30 may be precisely and finely adjusted.

In effect, as this ball bearing 58 is placed perpendicular to the movement of the shank of the micrometric height adjustment screw 50, a differential pressure may be achieved on the height of the upper support 30, i.e., by a very discrete movement of the micrometric screw 50, the ball 58 moves along the fluted crown 52 and each time falls into the hollow in such crown, producing a slight sound of the movement, and in turn, small adjustments may be made to the height of the upper support 30, and vice-versa.

On the other hand, the top of the upper support 30 has a rectangular hole 60, which acts as a guide for the centering movement of either an open sight 62 or a closed sight 70, such top face being provided with a centering scale 61, precisely in front of the rectangular hole 60, this scale being marked with divisions as a reference in relation to the centering of the sight.

The open sight 62 is formed by an angled plate, with a small cut-out 64 located centrally for sighting, and a rectangular protuberance 66, which is situated towards the bottom of the horizontal angled plate and coincides with the rectangular hole 60 that acts as a guide through which the upper support 30 moves and is fastened by means of a micrometric centering screw 80, which passes through the rectangular protuberance 66 and where this micrometric centering screw 80 is formed by a screw with a fine thread and a fluted crown 82 where a ball bearing 92 rests, being held in place by a spring 90 and both the ball bearing and spring being held in place by a cap 94, which allows the precise and fine centering movement of the sight.

The closed sight 70 is formed by a cylindrical piece with a central eyepiece 74 for sighting, and a rectangular protuberance 72, which is located towards the bottom of the horizontal angled piece and coincides with the rectangular hole 60 that acts as a guide through which the upper support 30 moves and to which it is attached by means of a micrometric centering screw 80.

The ball bearing 92 and spring 90 are placed on the back face of the upper support 30, perpendicular to the thread of the micrometric centering screw 80, by means of which the centering movement of the sight can be carried out in a precise and fine manner.

In effect, as this ball bearing 92 is placed perpendicular to the movement of the shank of the micrometric centering screw 80, a differential pressure may be achieved on the height of the upper support 30, i.e., by a very discrete movement of the micrometric centering screw 80, the ball 92 moves along the fluted crown 82 and each time falls into the hollow in such crown, producing a slight sound of the movement, and in turn, small adjustments may be made to center the sight.

The use of the open sight 62 or of the closed sight 70, is according only to the preferred grouping of shots. Therefore, for example, if a very rigid grouping is required, then the closed sight is preferred, and vice-versa.

Regarding the method of use of the invention, this is as simple as can be, and does not require complicated explanations.

The base 10 is mounted on the dovetail slide that is situated towards the back of the gun's barrel, after selecting the open sight 62 or the closed sight 70.

At the same time, the sight is centered using the micrometric centering screw 80.

The height of the upper support 30 is fixed, moving the micrometric height adjustment screw 50, and if possible, an approximation shot is fired. Depending on the result, the height is adjusted and fixed permanently in position.

According to the results obtained after several shots, the accessory may be adjusted according to the aforementioned steps, by raising or reducing the height of the upper support 30.

I claim:

1. An apparatus for a rifle comprising:

a gun barrel having a dovetail formed adjacent a back thereof;

a rifle sight positioned on said dovetail of said gun barrel, said rifle sight comprising:

a base having a fixed part and a movable part, said movable part defining a clamp, said fixed part and said movable part being attached to slide on said dovetail;

an upper support having a side plate so as to define an angled plate;

a micrometric height adjustment screw affixed to a top surface of said upper support; and a micrometric centering screw cooperative with said upper support, said fixed part having a rectangular-shaped piece with a protuberance extending downwardly therefrom so as to define a slide on one face thereof, said angled plate of said upper support slidable along said slide, said angled plate having an inclined cut-out on respective side faces thereof so as to slidably engage said dovetail, said fixed part having a hole with a thread formed therein, said micrometric height adjustment screw threadedly engaged with said thread of said hole, said fixed part having a flat rectangular plate on a top face thereof, said movable part of said base having a rectangular piece with an inclined cut-out on an inside face thereof positioned so as to be cooperative with and secured to said dovetail, said movable part having another plurality of set screws extending transversely to said inclined cut-out, said another plurality of set screws securing said fixed part of said base to said movable part and for securing said base to said dovetail, said upper support having a scale with divisions representative of a height at which said upper support is placed, said flat plate of said upper support being fixed in a predetermined position by a spring means at one end thereof, said spring means having a ball bearing for exerting pressure on a rear face of said angled plate and for fixing said angled plate into a position, said micrometric height adjustment screw being positioned on said top face of said upper support, said micrometric height adjustment screw having a screw with a thread formed thereon and a fluted crown upon which said ball bearing of said spring means rests so as to be perpendicular to a movement of said height adjustment screw, said upper support having a rectangular hole with a scale marked with divisions relative to a centering of said sight relative to said gun barrel; and an open sight formed of another angled plate with a cut-out centrally positioned, said open sight having a rectangular protuberance positioned at a bottom of a horizontal portion of said another angled plate so as to coincide with said rectangular hole such that said rectangular hole guides said upper support, said open sight being fastened to said upper support by said micrometric centering screw, said micrometric centering screw having a thread and a fluted crown, another ball bearing being resiliently positioned perpendicularly against said fluted crown.

2. The apparatus of claim 1, said flat rectangular plate covering a space between said base and said upper support.

3. An apparatus for a rifle comprising:

a gun barrel having a dovetail formed adjacent a back thereof;

a rifle sight positioned on said dovetail of said gun barrel, said rifle sight comprising:

a base having a fixed part and a movable part, said movable part defining a clamp, said fixed part and said movable part being attached to slide on said dovetail;

an upper support having a side plate so as to define an angled plate;

a micrometric height adjustment screw affixed to a top surface of said upper support; and a micrometric centering screw cooperative with said upper support, said fixed part having a rectangular-shaped piece with a protuberance extending downwardly therefrom so as to define a slide on one face thereof, said angled plate of said upper support slidable along said slide, said angled plate having an inclined cut-out on respective side faces thereof so as to slidably engage said dovetail, said fixed part having a hole with a thread formed therein, said micrometric height adjustment screw threadedly engaged with said thread of said hole, said fixed part having a flat rectangular plate on a top face thereof, said movable part of said base having a rectangular piece with an inclined cut-out on an inside face thereof positioned so as to be cooperative with and secured to said dovetail, said movable part having another plurality of set screws extending transversely to said inclined cut-out, said another plurality of set screws securing said fixed part of said base to said movable part and for securing said base to said dovetail, said upper support having a scale with divisions representative of a height at which said upper support is placed, said flat plate of said upper support being fixed in a predetermined position by a spring means at one end thereof, said spring means having a ball bearing for exerting pressure on a rear face of said angled plate and for fixing said angled plate into a position, said micrometric height adjustment screw being positioned on said top face of said upper support, said micrometric height adjustment screw having a screw with a thread formed thereon and a fluted crown upon which said ball bearing of said spring means rests so as to be perpendicular to a movement of said height adjustment screw, said upper support having a rectangular hole with a scale marked with divisions relative to a centering of said sight relative to said gun barrel; and a closed sight formed of a cylindrical piece with a central eyepiece and a rectangular protuberance at a bottom thereof, said rectangular protuberance coinciding with said rectangular hole such that said rectangular hole guides said upper support, said closed sight being fastened to said upper support by said micrometric centering screw, said micrometric centering screw having a thread and a fluted crown, another ball bearing being resiliently positioned perpendicularly against said fluted crown.

* * * * *